US005673788A

United States Patent [19]

McLane

[11] Patent Number: 5,673,788

[45] Date of Patent: Oct. 7, 1997

[54] COLLAPSIBLE HOLDER

[76] Inventor: Kevin J. McLane, 2331 E. 12th Ave., Denver, Colo. 80206

[21] Appl. No.: 672,945

[22] Filed: Jul. 1, 1996

[51] Int. Cl.[6] ..... A45C 11/04

[52] U.S. Cl. ..... 206/5; 206/6

[58] Field of Search ..... 206/5, 6, 6.1, 566, 206/748, 749; 150/154, 146; 190/107; 220/4.28, 4.29

[56] References Cited

U.S. PATENT DOCUMENTS

| | | | |
|---|---|---|---|
| 409,703 | 8/1889 | Procter | 206/748 |
| 602,025 | 4/1898 | White . | |
| 615,748 | 12/1898 | Bodwell | 206/748 |
| 1,004,474 | 9/1911 | Schnorr . | |
| 2,353,413 | 7/1944 | Nathan . | |
| 2,650,700 | 9/1953 | Wolf | 206/5 |
| 2,667,965 | 2/1954 | Laibson . | |
| 2,777,489 | 1/1957 | Stegeman . | |
| 3,101,843 | 8/1963 | Thompson . | |
| 3,276,572 | 10/1966 | Everburg . | |
| 3,314,464 | 4/1967 | Veilleux | 150/154 |
| 3,921,797 | 11/1975 | Platt . | |
| 3,977,516 | 8/1976 | Tilve . | |
| 4,388,959 | 6/1983 | Handy et al. . | |
| 4,930,635 | 6/1990 | Hotchkiss et al. | 150/154 |
| 5,032,019 | 7/1991 | Burchett | 206/5 |
| 5,377,794 | 1/1995 | Book | 190/107 |

*Primary Examiner*—David T. Fidei

*Attorney, Agent, or Firm*—Klaas, Law, O'Meara & Malkin, P.C.

[57] ABSTRACT

A collapsible holder for protecting an article or articles contained therein, and in particular sunglasses, wherein at least three relatively rigid members of a generally rectangular shape are pivotally connected together and a separable closure is provided so that the at least three relatively rigid members may be formed into a rigid triangular shape for holding the sunglasses when not in use and folded into a compact relationship with the at least three relatively rigid members in a superposed parallel relationship when the sunglasses are in use.

20 Claims, 2 Drawing Sheets

COLLAPSIBLE HOLDER

FIELD OF THE INVENTION

This invention is directed generally to holders for protecting articles contained therein, and more particularly to a collapsible holder for protecting articles contained therein while being used as a holder and the retention thereof when not being used as a holder.

BACKGROUND OF THE INVENTION

There are many instances where a holder is made available for use in protecting an article or articles contained therein but raises a question as to its retention when the article or articles are removed therefrom. When there is a breakable device that is only used some of the time but such use occurs at spaced apart intervals and at different locations, there is a necessity for a holder to protect the breakable device when not in use but is being transported for future use. This also creates the problem of what to do with the holder when the breakable device is being used. This problem is annoyable when related to reading glasses but is more so in relation to sunglasses since the holder is required to be rigid to protect the sunglasses from breakage but, because of this, presents a bulky storage problem when the sunglasses are in use. Everburg in U.S. Pat. No. 3,276,572 presents a partial solution by shaping a case for spectacles so that it may be folded while not in use. However, there is nothing in Everburg to resist deleterious forces applied to the case that could do harm to the spectacles while in the case. While there are many products for the protection of eyeglasses while not in use, there are no eyeglass cases, that applicant is aware of, that solves the combined use-non-use problem described above.

BRIEF DESCRIPTION OF THE INVENTION

This invention provides a collapsible holder for a breakable device, such as eyeglasses and more particularly sunglasses, that provides a rigid protective holder for the breakable device when the breakable device is not in use and a compact readily storable product when the breakable device is in use. While the collapsible holder is described herein as providing protection for sunglasses, it is understood that the collapsible holder can be used for holding other breakable articles or any article that must be protected while not in use or being transported from one location to another location and which holder can then be folded into a compact readily storable product.

In one preferred embodiment of the invention, the collapsible holder for a breakable device, which for convenience sake will hereafter be referred to as sunglasses, comprises at least three relatively rigid members each having a generally rectangular shape having a length, a width and a thickness. Each of the at least three relatively rigid members has a generally planar inner surface and a generally planar outer surface which are generally smooth and uniform. At least two pivot means are provided and extend generally in a lengthwise direction for pivotally connecting a first one of the at least three relatively rigid members to a second one and to a third one of the at least three relatively rigid members. Separable holding means are provided for holding the at least three relatively rigid member in a spaced apart relationship when the at least three relatively rigid members have been pivoted to form an open ended triangular shape in transverse cross-section with the inner generally planar surfaces thereof in a facing relationship to form a cavity for containing the sunglasses when not in use.

Relatively flexible closure means are provided for closing the open ends to prevent the sunglasses from falling out of the ends of the cavity.

When the separable holding means have been separated, the at least two pivot means permit relative movement between the at least three relatively rigid members to a position whereat the generally planar inner and outer surfaces are in a superposed, parallel, compact relationship. In a preferred embodiment of the invention, the at least two pivot means permit pivotal movement between the first one and the second one to a position whereat the generally planar inner surface of the first one is superposed over and parallel to the generally planar inner surface of the second one and also, permitting pivotal movement between the first one and the third one to a position whereat the generally planar outer surface of the third one is superposed over and parallel to the generally planar outer surface of the first one. Protecting material is located at least between the generally planar inner surfaces and the sunglasses.

In one preferred embodiment of the invention, the protecting material comprises at least one sheet of a relatively flexible protecting material having portions thereof in a superposed relationship to have an inner surface and an outer surface. Portions of the superposed portions are secured together to form a plurality of spaced apart pockets with each of the pockets having one of the at least three relatively rigid members contained therein. Each pocket can have an open end for insertion or removal of a relatively rigid member. The pivot means comprise portions of the at least one sheet of a relatively flexible protecting material that has been secured together between adjacent pockets. The separable holding means comprise a flap portion extending outwardly from one of the pockets and having a first part of a velcro fastener secured thereon and a second part of the velcro fastener is secured to a portion of the outer surface of one of the pockets formed in the at least one sheet of a relatively flexible protecting material. The at least one sheet of a relatively flexible protecting material can comprise two sheets of a relatively flexible protecting material and one of the two sheets being larger than the other of the two sheets to provide the flap portion. The closure means for closing the open ends comprise a plurality of triangularly shaped portions each of which can be integral with the at least one sheet of a relatively flexible material or one of the two sheets of a relatively flexible material and extends outwardly from one of the opposite end portions at each end portion of two adjacent pockets and the triangularly shaped portions of the two adjacent pockets have edge portions that can be placed in a superposed relationship and secured together. Each of the at least three relatively rigid members is formed from relatively high density plastic material.

In another preferred embodiment of the invention, one of the at least two pivot means is integral with the first one and the second one of the at least three relatively rigid members and the other of the at least two pivot means is integral with the first one and the third one of the at least three relatively rigid members. Each of the at least three relatively rigid members and the pivot means is formed from a relatively high density plastic material and the integral pivot means have a thickness less than the thickness of each of the at least three relatively rigid members. Protecting material is secured to the inner surface of each of the at least three relatively rigid members. The separable holding means comprise a first portion of a velcro fastener secured to and extending from the third one of the at least three relatively rigid members and a second portion of the velcro fastener secured to the outer surface of the second one of the at least three relatively rigid members. The first and second portions of the velcro fastener preferably extend for the length of the second and third ones but can extend for a shorter distance.

In another preferred embodiment of the invention, the third one of the at least three relatively rigid members has an exposed lengthwise extending end surface and the inner surface of second one of the at least three relatively rigid members has a width such that, when the separable holding means are holding the at least three relatively rigid members in a spaced apart relationship, at least a portion of the inner surface of the second one of the at least three relatively rigid members abuts against at least a portion of the exposed lengthwise extending end surface.

In another preferred embodiment of the invention, the collapsible rigid holder comprises at least four relatively rigid members each having a generally rectangular shape having a length, a width and a thickness. Each of the at least four relatively rigid members has a generally planar inner surface and a generally planar outer surface which also are generally smooth and uniform. At least three pivot means are provided and extend generally in a lengthwise direction for pivotally connecting a first one of the at least four relatively rigid members to a second one and to a third one of the at least four relatively rigid members and for pivotally connecting the third one to a fourth one of the at least four relatively rigid members. Separable holding means are provided for holding the at least four relatively rigid members in a relationship wherein the inner generally planar surfaces of the first, third and fourth ones are in a facing relationship to form an open ended triangular shape and the outer generally planar surface of the fourth one is in a superposed parallel relationship with the inner generally planar surface of the second one to form a cavity containing the sunglasses when not in use. Relatively flexible closure means are provided for closing the open ends to prevent the sunglasses from falling out of the cavity. When the separable holding means have been separated, the at least three pivot means permit relative pivotal movement between the at least four relatively rigid members to a position wherein the generally planar inner and outer surfaces thereof are in a superposed parallel relationship. In this another preferred embodiment of the invention, the at least three pivot means permit the pivotal movement between the first one and the second one to a position whereat the generally planar inner surface of the first one is superposed over and parallel to the generally planar inner surface of the second one and the pivotal movement between the first one and the third one to a position whereat the generally planar outer surface of the third one is superposed over and parallel to the outer generally planar surface of the first one and the pivotal movement between the fourth one and the third one to a position whereat the generally planar inner surface of the fourth one is superposed over and parallel to the inner surface of the third one.

BRIEF DESCRIPTION OF THE DRAWINGS

Illustrative and presently preferred embodiments of the invention are illustrated in the drawings in which.

DETAILED DESCRIPTION OF THE INVENTION

Figure 1:
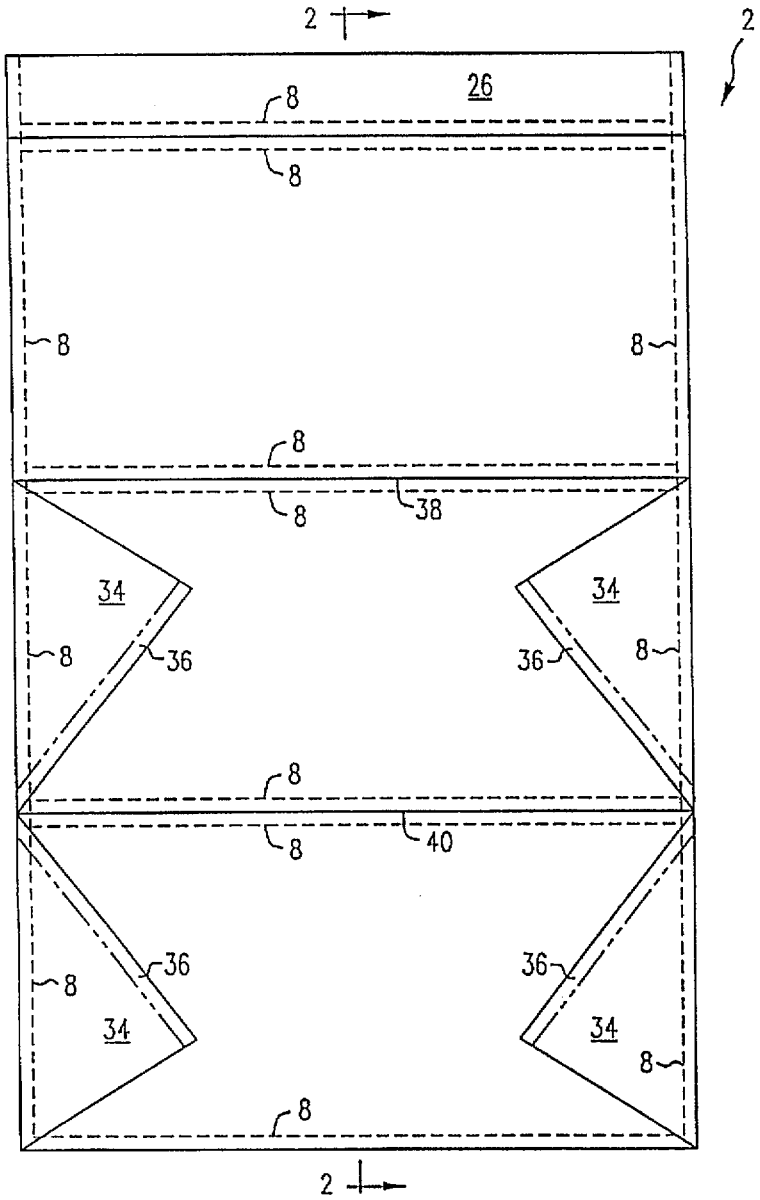
FIG. 1 is a top plan view of a preferred embodiment of a collapsible holder of the invention prior to final assembly.

In FIGS. 1–4, there is illustrated one preferred embodiment of a collapsible holder 2 of this invention. In the drawings, the relative thicknesses of the various components have been enlarged for illustration purposes only. However, the actual thicknesses of the various components will permit the functions of the various structures as described below. One sheet of a relatively flexible protective material, such as a rubberized double-sided cotton sheeting or other material having similar characteristics or other synthetic materials, is folded over to form two layers 4 and 6 which are secured together by stitching 8 to form a plurality of pockets 10, 12 and 14. Prior to forming the final stitching 8, a first relatively rigid member 16 is inserted into the pocket 12; a second relatively rigid member 18 is inserted into the pocket 14 and a third relatively rigid member 20 is inserted into the pocket 10. If desired one end of each pocket 10, 12 and 14 may be left open for insertion or removal of one of the at least three relatively rigid members 16, 18 and 20. The pockets 10, 12 and 14 are then closed by the stitching 8 to enclose the relatively rigid members 16, 18 and 20 which are rectangular in shape and have a length, a width and a thickness. Each of the relatively rigid members 16, 18 and 20 has an outer surface 22 and an inner surface 24. The outer and inner surfaces 22 and 24 are substantially smooth and uniform. The relatively rigid members 16, 18 and 20 are preferably formed from a relatively high density plastic material, such as styrene or other materials having similar characteristics, but could also be formed from metallic materials or highly pressed paper materials. The layer 6 is slightly larger than the layer 4 so as to form a flap portion 26 for a purpose described below. A first portion 28 of a velcro fastener is secured to the flap portion 26 and a second portion 30 of the velcro fastener is secured to the sheet 6 at a location adjacent to the end 32 of the pocket 14. While one sheet of a relatively flexible protective material is illustrated, it is understood that two sheets of a relatively flexible protective material, suitably stitched together may be used.

Triangularly shaped portions 34 integral with the layer 6 extend outwardly therefrom adjacent to each end of the pockets 12 and 14 and are secured together by stitching or other means (not shown) along the border areas 36 to form end closures as described below. It is understood that other means may be utilized to form the end closures. The stitching 8 between the pockets 10, 12 and 14 provide two pivot means 38 and 40 for permitting relative pivotal movement between the first and second relatively rigid members 16 and 18 and between the first and third relatively rigid members 16 and 20. The stitched together triangularly shaped portions 34 limit the distance that the relatively rigid members 16 and 18 may be moved apart.

Figure 2:
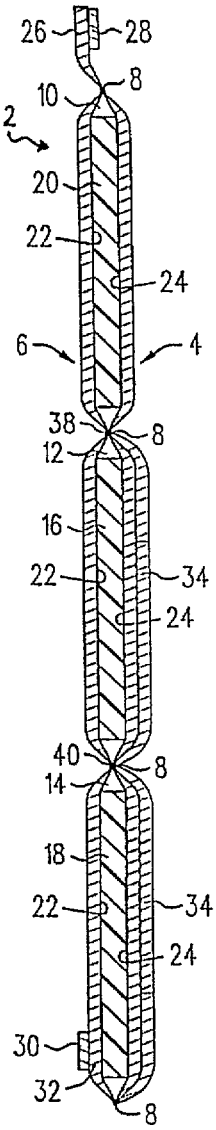
FIG. 2 is a cross-sectional view taken on the line 2—2 of FIG. 1.
Figure 3:
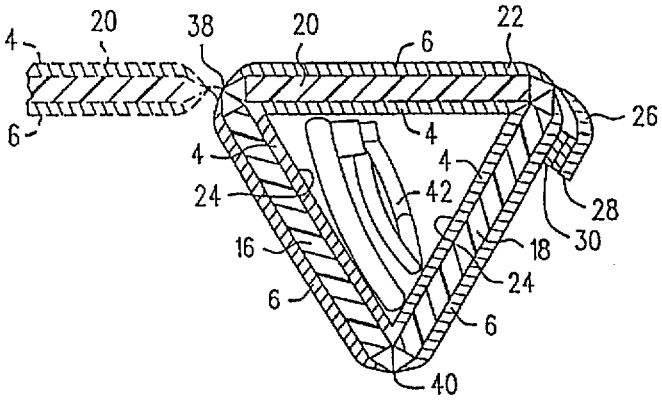
FIG. 3 is a view in cross-section of a collapsible holder of this invention in a position to hold a breakable device.

In FIG. 3 the first and second relatively rigid members 16 and 18 have been moved apart by movement around the pivot means 40 until stopped by the secured together triangularly shaped portions 34. The relatively rigid member 20 has been pivoted about the pivot means 38 to an opened position, as illustrated by the dashed lines. The sunglasses 42 can then be placed in the cavity formed by the opened first and second relatively rigid members 16 and 18. After the sunglasses 42 have been placed in the cavity, the third relatively rigid member 20 is pivoted around the pivot means 38 and the flap portion 26 is moved so that the first and second portions 28 and 30 of the velcro fastener may be secured together to hold the three relatively rigid members 16, 18 and 20 in a spaced apart relationship. As illustrated in FIGS. 1 and 2 the flap portion 26 and the first and second portions 28 and 30 of the velcro fastener have substantially the same lengthwise extent as the sheets 4 and 6 forming the pockets 10, 12 and 14. However, if desired the flap portion 26 and the first and second portions 28 and 30 of the velcro fastener can have a shorter lengthwise extent but the full lengthwise extent gives greater rigidity for safely holding the sunglasses 42. It is understood that other fastening means can be used as long as they provide sufficient strength to hold the first, second and third relatively rigid members 16, 18 and 20 in the spaced apart relationship illustrated in FIG. 3. While the first, second and third relatively rigid members 16, 18 and 20 preferably have substantially the same length, width and thickness, in some instances, the third relatively rigid member 20 can have a thickness greater than the thickness of the first and second relatively rigid members 16 and 18 to provide abutment surfaces preventing the movement of the first and second relatively rigid members 16 and 18 toward each other when in the assembled position illustrated in FIG. 3.

Figure 4:
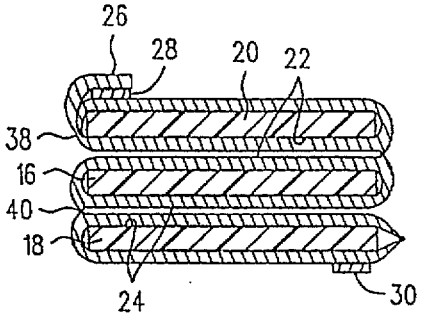
FIG. 4 is a view in cross-section of a collapsible holder of the invention in a folded position after the breakable device has been removed.
Figure 5:
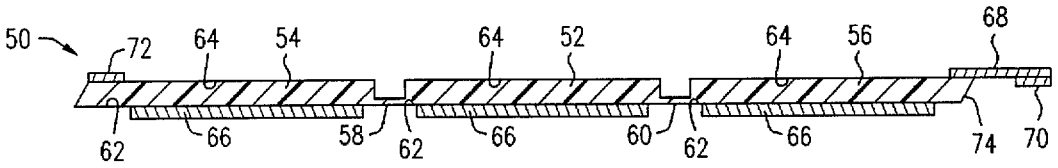
FIG. 5 is a view in cross-section of another preferred embodiment of a collapsible holder of the invention.

When the first and second portions 28 and 30 are separated and the third relatively rigid member 20 has been pivoted to the opened position and the sunglasses 42 have been removed, the collapsible holder 2 can then be folded to the compact configuration illustrated in FIG. 4. The first and second relatively rigid members 16 and 18 are pivoted about the pivot means 40 until the inner surfaces 24 thereof are in a superposed, parallel relationship. The third relatively rigid member 20 is pivoted around the pivot means 38 until the outer surface 22 of the third relatively rigid member 20 is superposed over and parallel to the outer surface 22 of the first relatively rigid member 16. This compact relationship allows the collapsible holder 2 to be readily stored when the sunglasses 42 are being worn.

Another preferred embodiment of the invention is illustrated in FIGS. 5–8. The collapsible holder 50 has a first relatively rigid member 52, a second relatively rigid member 54 and a third relatively rigid member 56. A pivot section 58 is integral with and pivotally connects the first and second relatively rigid members 52 and 54. Another pivot section 60 is integral with and pivotally connects the first and third relatively rigid members 52 and 56. The first, second and third relatively rigid member 52, 54 and 56 have a generally rectangular configuration having a length, a width and a thickness. Each of the first, second and third relatively rigid members 52, 54 and 56 has a generally planar inner surface 62 and a generally planar outer surface 64. The generally planar inner and outer surfaces 62 and 64 are substantially smooth and uniform. The first, second and third relatively rigid members 52, 54 and 56 and the pivot sections 60 and 62 are preferably formed from any relatively high density extrudable or moldable plastic material. The pivot sections 58 and 60 have a thickness substantially smaller that the thickness of the first, second and third relatively rigid members 52, 54 and 56. A sheet 66 of a relatively flexible protective material is secured to the inner surface 62 of each of the first, second and third relatively rigid members 52, 54 and 56. A relatively flexible flap portion 68 is secured to but also may be integral with a portion of the outer surface 64 of the third relatively rigid member 56 and projects outwardly therefrom. A first portion 70 of a velcro fastener is secured to the projecting portion of the flap portion 68 and a second portion 72 of the velcro fastener is secured to a portion of the outer surface 64 of the second relatively rigid member 54. The flap portion 68 and the first and second portions 70 and 72 have a length that is substantially the same as the length of the second and third relatively rigid members 54 and 56. If desired, the third relatively rigid member 56 can be provided with an inclined end surface 74 for a purpose described below. A triangularly shaped piece 76, FIG. 7, of a relatively thin flexible material, such a as a polyethylene plastic material, or other materials having similar characteristics, is folded in half and the end portions 78 thereof are secured to opposite end portions of the inner surfaces 62 of the first and second relatively rigid members 52 and 54 by suitable means such as an adhesive. The triangularly shaped pieces 76 form closure members as described above and also limit the distance that the first and second relatively rigid members 52 and 54 can be pivoted apart. If desired, a fourth relatively rigid member (not shown), of the type described below, can be pivotally connected to the third relatively rigid member by a pivot section similar to the pivot sections 58 and 60.

Figure 6:
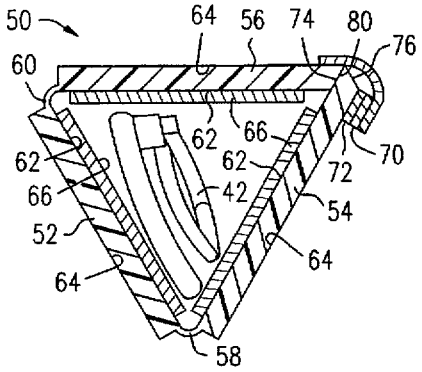
FIG. 6 is a view in cross-section of a collapsible holder of FIG. 5 in a position to hold a breakable device.
Figure 7:
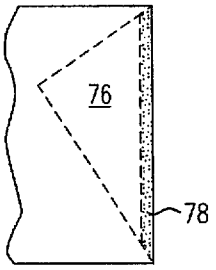
FIG. 7 is a partial plan view illustrating the end closure means for FIG. 6.

In FIG. 6, the first, second and third relatively rigid members 52, 54 and 56 have been folded to a position similar to that illustrated in FIG. 3. The third relatively rigid member 56 had been moved to an open position so that the sunglasses 42 could be inserted and then moved to the closed position illustrated in FIG. 6. The first and second portions 70 and 72 of the velcro fastener are secured together to hold the first, second and third relatively rigid members 52, 54 and 56 in the desired spaced apart relationship. The first, second and third relatively rigid members 52, 54 and 56 can have the same dimensions or if desired can be dimensioned, as illustrated in FIG. 6, wherein the second relatively rigid member 54 has a width of a sufficient extent so that a portion 80 of its inner surface 62 abuts against the inclined end surface 74 of the third relatively rigid member 56 to cooperate with the first and second portions 70 and 72 to limit the relative movement of the second and third relatively rigid members 54 and 56 toward each other.

Figure 8:
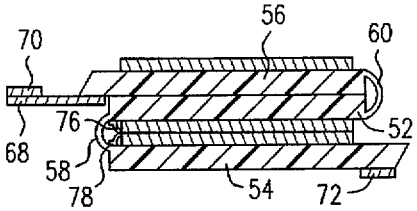
FIG. 8 is a view in cross-section of a collapsible holder of FIG. 5 in a folded position after the breakable device has been removed.

In FIG. 8, the sunglasses 42 have been removed and the first, second and third relatively rigid members 52, 54 and 56 have been folded around the pivot sections 58 and 60 into a compact relationship similar to FIG. 4. The first and second relatively rigid members 52 and 54 have been folded around the pivot section 58 so that the inner surfaces 62 thereof are in a superposed parallel relationship. The third relatively rigid member 56 has been folded around the pivot section 60 until the outer surfaces 64 of the first and third relatively rigid members 52 and 56 are in a superposed parallel relationship.

Figure 9:
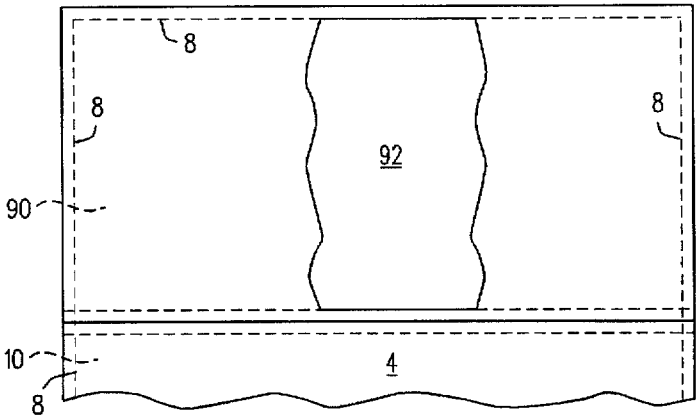
FIG. 9 is a partial top plan view illustrating another preferred embodiment of the invention.
Figure 10:
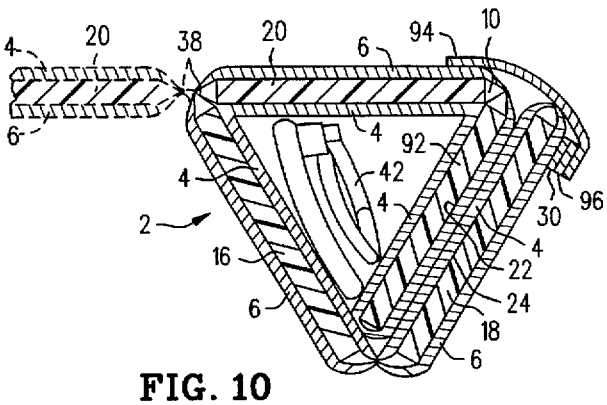
FIG. 10 is a view in cross-section of the collapsible holder of FIG. 9 in a position to hold a breakable device.

Another preferred embodiment of the invention is illustrated in FIGS. 9–10 which embodiment is similar to the embodiment of 1–4 so that, where the same parts are referred to, the same reference numerals have be used instead of the flap portion 26, the layers 4 and 6 are enlarged and the stitching 8 forms another pocket 90 in which a fourth relatively rigid member 92 is located. As illustrated in FIG. 10, a flexible flap portion 94 is secured to a portion of the sheet 6 forming the pocket 10 for the third relatively rigid member 20 and has first portion 96 of a velcro fastener secured thereto so that it may be secured to the second portion 30 of the velcro fastener. When folded to form a collapsible holder 2 for the sunglasses 42 as illustrated in FIG. 10, the fourth relatively rigid member 92 is located so that the outer surface 22 thereof is superposed over and parallel to the inner surface 24 of the second relatively rigid member 18. If desired, the pocket 90 can be omitted and the relatively rigid member 92 can be secured to the flap 26 for pivotal movement relative to the third relatively rigid member 20.

Figure 11:
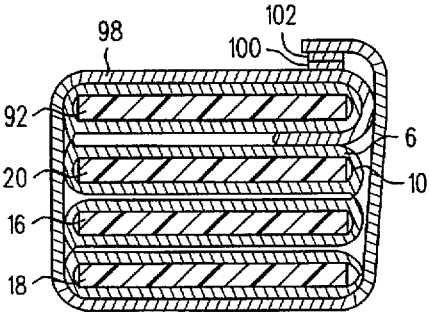
FIG. 11 is a view in cross-section of another embodiment of the collapsible holder of FIG. 9 in a folded position after the breakable device has been removed.

Another preferred embodiment of the invention is illustrated in FIG. 11 which is a view of FIG. 10 folded into a compact relationship. In FIG. 11, a flap portion 98 has one end portion secured to the portion of the sheet 6 forming the pocket 10, similar to the flap 94, and is then moved over the pocket 90, around the folded rigid members 92, 20, 16 and 18 and back so that one portion 100 of a velcro fastener secured to a portion of flap portion 98 can be secured to a second portion 102 of the velcro fastener secured to another portion of the flap portion 98.

When used as a holder for conventional sunglasses, the relatively rigid members 16, 18, 20, 52, 54, 56 and 92 will have a length of about 6.0 inches, a width of about 3.0 inches and a thickness of about 0.125 inch. In the preferred embodiment of FIGS. 5–8, the sections 58 and 60 will have a thickness of about 0.020 inch. It is understood that these dimensions are for illustration purposes only.

It is contemplated that the inventive concepts herein described may be variously otherwise embodied and it is intended that the appended claims be construed to include alternative embodiments of the invention except insofar as limited by the prior art.

What is claimed is:

1. A collapsible rigid holder for protecting articles contained therein comprising:

at least three relatively rigid members each having a generally rectangular shape having a length, a width and a thickness;

each of said at least three relatively rigid members having a generally planar inner surface and a generally planar outer surface;

at least two pivot means extending generally in a lengthwise direction for pivotally connecting a first one of said at least three relatively rigid members to a second one and to a third one of said at least three relatively rigid members.

separable holding means for holding said at least three relatively rigid members in a spaced apart relationship when said at least three relatively rigid members have been pivoted to form an open ended triangular shape with said generally planar inner surfaces thereof in a facing relationship to form a cavity for containing at least one article when not in use;

relatively flexible closure means for closing at least a portion of said open ends to prevent said at least one article form falling out of said cavity; and when said separable holding means have been separated and said at least one article has been removed, said at least two pivot means permitting relative pivotal movement between said at least three relatively rigid members to a position wherein said generally planar inner and outer surfaces thereof are in a superposed parallel compact relationship.

2. A collapsible rigid holder as in claim 1 wherein:

said at least two pivot means permitting pivotal movement between said first one and said second one to a position whereat said generally planar inner surface of said first one is superposed over and parallel to said generally planar inner surface of said second one and permitting pivotal movement between said first one and said third one to a position whereat said generally planar outer surface of said third one is superposed over and parallel to said generally planar outer surface of said first one.

3. A collapsible rigid holder as in claim 1 further comprising:

protecting material at least between said generally planar inner surfaces and said at least one article.

4. A collapsible rigid holder as in claim 3 wherein said protecting material comprises:

at least one sheet of a relatively flexible protecting material having portions thereof in a superposed relationship to have an inner surface and outer surface;

securing means for securing together portions of said superposed portions to form a plurality of spaced apart pockets; and each of said pockets having one of said at least three relatively rigid members contained therein.

5. A collapsible rigid holder as in claim 4 wherein said at least two pivot means comprise:

portions of said at least one sheet of a relatively flexible protecting material between adjacent pockets being secured together.

6. A collapsible rigid holder as in claim 4 wherein said separable holding means comprise:

a flap portion extending outwardly from one of said pockets and having a first part of a velcro fastener secured thereon; and a second part of the velcro fastener secured to a portion of said at least one sheet of relatively flexible fastening material forming one of said pockets.

7. A collapsible rigid holder as in claim 6 wherein:

said at least one sheet of a relatively flexible protecting material comprises two sheets of a relatively flexible protecting material; and one of said two sheets being larger than the other of said two sheets to provide said flap portion.

8. A collapsible rigid holder as in claim 4 wherein each of said relatively flexible closure means comprise:

relatively flexible material integral with opposite end portions of said at least one sheet of a relatively flexible protecting material adjacent to two adjacent pockets and having adjacent overlapping portions thereof secured together.

9. A collapsible rigid holder as in claim 4 wherein:

each of said at least three relatively rigid members is formed from a relatively high density plastic material.

10. A collapsible rigid holder as in claim 1 wherein:

one of said at least two pivot means being integral with said first one and said second one of said at least three relatively rigid members; and the other of said at least two pivot means being integral with said first one and said third one of said at least three relatively rigid members.

11. A collapsible rigid holder as in claim 10 and further comprising:

protecting material secured to said inner surface of each of said at least three relatively rigid members.

12. A collapsible rigid holder as in claim 10 wherein:

each of said at least three relatively rigid members having substantially the same dimensions and being formed from a relatively high density plastic material.

13. A collapsible rigid holder as in claim 10 wherein:

each of said at least two integral pivot means having a thickness less than the thickness of each of said at least three relatively rigid members.

14. A collapsible rigid holder as in claim 9 wherein:

said separable holding means comprise a first portion of a velcro fastener secured to and extending from said third one and a second portion of said velcro fastener secured to said second one.

15. A collapsible rigid holder as in claim 14 wherein:

said first and second portions of said velcro fastener extend for the length of said second and third ones.

16. A collapsible rigid holder as in claim 9 wherein:

said third one has an exposed lengthwise extending end surface; and said inner surface of second one having a width such that, when said holding means are holding said at least three relatively rigid members in a spaced apart relationship, at least a portion of said inner surface of said second one abuts against at least a portion of said exposed lengthwise extending surface.

17. A collapsible rigid holder as in claim 9 and further comprising:

at least a fourth relatively rigid member;

a third pivot means integral with said third one and said at least a fourth relatively rigid member;

said at least a fourth relatively rigid member having an inner surface and an outer surface;

protecting material secured to said inner surface of said at least a four relatively rigid member; and when said holding means are holding said at least three relatively rigid members is said spaced apart relationship said outer surface of said at least a fourth relatively rigid member is superposed over and parallel to said inner surface of said second one.

18. A collapsible rigid holder as in claim 1 wherein said at least one article contained therein comprises:

sunglasses.

19. A collapsible rigid holder for protecting articles contained therein comprising:

at least four relatively rigid members each having a generally rectangular shape having a length, a width and a thickness;

each of said at least four relatively rigid members having a generally planar inner surface and a generally planar outer surface;

at least three pivot means extending generally in a lengthwise direction for pivotally connecting a first one of said at least four relatively rigid members to a second one and a third one of said at least four relatively rigid members and for pivotally connecting said third one to a fourth one of said at least four relatively rigid members;

separable holding means for holding said at least four relatively rigid members in a relationship wherein said generally planar inner surfaces of said first, third and fourth ones are in a facing relationship to form an open ended triangular shape and said outer generally planar surface of said fourth one is in a superposed parallel relationship with said generally planar inner surface of said second one to form a cavity containing said at least one article when not in use;

relatively flexible closure means for closing said open ends to prevent said at least one article from falling out of said cavity; and when said separable holding means have been separated and said at least one article has been removed, said at least three pivot means permitting relative pivotal movement between said at least four relatively rigid members to a position whereat said generally planar inner and outer surfaces are in a superposed parallel compact relationship.

20. A collapsible rigid holder as in claim 19 wherein:

said at least three pivot means permitting pivotal movement between said first one and said second one to a position whereat said generally planar inner surface of said first one is superposed over and parallel to said generally planar inner surface of said second one and permitting pivotal movement between said first one and said third one to a position whereat said generally planar outer surface of said third one is superposed over and parallel to said outer generally planar surface of said first one and permitting relative pivotal movement between said fourth one and said third one to a position whereat said generally planar inner surface of said fourth one is superposed over and parallel to said generally planar inner surface of said third one.

* * * * *